US007107798B2

(12) United States Patent
Vaidhyanathan et al.

(10) Patent No.: US 7,107,798 B2
(45) Date of Patent: Sep. 19, 2006

(54) DRIVE MECHANISM FOR AN AUTOMATIC WASHER

(75) Inventors: Raveendran Vaidhyanathan, St. Joseph, MI (US); Matthew C. Parsons, Dowagiac, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 512 days.

(21) Appl. No.: 10/064,890

(22) Filed: Aug. 27, 2002

(65) Prior Publication Data

US 2005/0011233 A1 Jan. 20, 2005

(51) Int. Cl.
*D06F 37/40* (2006.01)

(52) U.S. Cl. ..... 68/19; 68/23 R; 68/131

(58) Field of Classification Search ..... 68/13 R, 68/19, 23 R, 131
See application file for complete search history.

(56) References Cited

U.S. PATENT DOCUMENTS 1,850,138 A * 3/1932 Riall ..... 68/148
2,119,918 A * 6/1938 Kirby ..... 68/23.5
2,227,077 A * 12/1940 Geldhof et al. ..... 137/387
2,313,984 A * 3/1943 Breckenridge et al. ..... 68/23.3
2,432,766 A * 12/1947 Kirby ..... 68/38
2,468,919 A * 5/1949 Brotman ..... 74/1 R
2,485,621 A * 10/1949 McNairy ..... 192/3.61
2,583,168 A * 1/1952 Fields ..... 68/23.6
2,609,697 A * 9/1952 Ruscoe ..... 74/70
2,625,248 A * 1/1953 Geldhof et al. ..... 192/116.5
2,630,001 A * 3/1953 Criner ..... 68/23.5
2,645,110 A * 7/1953 Dayton ..... 68/23.7
2,656,702 A * 10/1953 Chapin ..... 68/154
2,699,682 A * 1/1955 Castner ..... 74/70
2,720,955 A * 10/1955 Young ..... 192/18 A
2,729,336 A * 1/1956 Swartz ..... 210/365
2,793,537 A * 5/1957 Schmitter ..... 74/330
2,797,569 A * 7/1957 Kirby ..... 68/23.3
2,869,698 A * 1/1959 Conlee ..... 192/48.5
2,930,216 A * 3/1960 Cazzaniga ..... 68/23.3
3,248,908 A * 5/1966 Pope ..... 68/12.16
3,517,507 A * 6/1970 Brundage ..... 60/423
3,557,580 A * 1/1971 Racenis ..... 68/23.7
4,194,414 A * 3/1980 Satoh et al. ..... 475/153

(Continued)

FOREIGN PATENT DOCUMENTS

JP 61-10993 * 1/1986

(Continued)

*Primary Examiner*—Frankie L. Stinson
(74) *Attorney, Agent, or Firm*—John F. Colligan; Robert O. Rice; Clifton G. Green

(57) ABSTRACT

A drive mechanism for a vertical axis automatic washer. The washer has a rotatable wash basket, a rotatable agitator concentrically mounted in the wash basket and a drive motor. The drive mechanism includes a first drive shaft driven by the motor at a first rotational speed and with a first torque. A second drive shaft is arranged to rotatingly drive the agitator. A mechanism is arranged between the first drive shaft and the second drive shaft to convert the first rotational speed and the first torque to a second rotational speed and a second torque at the second drive shaft. A first clutch is arranged between the wash basket and the first drive shaft to allow for selective engagement and disengagement between the wash basket and the first drive shaft. A second clutch is arranged between the wash basket and the second drive shaft to allow for selective engagement and disengagement between the wash basket and the second drive shaft.

20 Claims, 4 Drawing Sheets

U.S. PATENT DOCUMENTS 4,220,232 A * 9/1980 Fey et al. ..... 192/103 B
4,440,004 A * 4/1984 Bochan ..... 68/23 R
4,528,485 A * 7/1985 Boyd, Jr. ..... 318/138
4,953,369 A * 9/1990 Ito ..... 68/23.7
5,209,708 A * 5/1993 Igaku ..... 475/156
5,619,871 A * 4/1997 Forbes et al. ..... 68/23.7
6,665,899 B1 * 12/2003 Lee et al. ..... 8/158

FOREIGN PATENT DOCUMENTS

JP 1-291894 * 11/1989
JP 5-42292 * 2/1993
JP 9-239185 * 9/1997
JP 2002-136072 * 5/2002

* cited by examiner

DRIVE MECHANISM FOR AN AUTOMATIC WASHER

BACKGROUND OF INVENTION

The present invention relates to an automatic clothes washer and more particularly to a vertical axis washer.

Automatic washers are known which have a direct drive system between the motor and the agitator and wash basket and these washers require a clutch mechanism so that the washer will be able to operate in an agitate mode wherein the agitator is oscillated while the basket is held stationary, and in a water extraction mode wherein the agitator and basket are spun together. Typically the agitation is performed at a relatively low speed, with high torque, and the spinning occurs at high speed with low torque.

In U.S. Pat. No. 4,890,465, a clutch mechanism for an automatic washer is disclosed which permits oscillatory motion of the agitator and results in rotary motion of the wash basket upon about 360° rotation of the agitator. This mechanism is disclosed in connection with a planetary drive wherein a first tang is carried on a planet carrier connected directly to the agitator and a second tang is carried on a ring gear connected directly to the wash basket. Engagement of the two tangs occurs upon sufficient rotary motion of the agitator wherein the basket tang will be picked up by the agitator tang causing the basket to rotate with the agitator. The wash basket is connected, via a spin tube, to co-rotate with the gear housing and when the basket is rotated, it is only in the high speed, low torque mode.

In U.S. Pat. No. 5,172,573 a clutch mechanism for an automatic washer is disclosed which includes a first clutch member drivingly connected to the motor and a second clutch member drivingly connected to the wash basket and selectively axially actuable for driving engagement with the first clutch member. In this manner, the high speed motor rotation is provided directly to the wash basket for high speed rotation of the wash basket.

Oscillatory agitation by an agitator provides too much flexing force on certain clothes loads that should be washed utilizing a delicate or hand wash method. While it is known to use variable speed motors to provide a less forceful agitation, such motors are typically more expensive than fixed speed motors.

It would therefore be an improvement in the art if there were provided an arrangement for effecting a slow speed and low impact agitation with a fixed speed motor.

SUMMARY OF INVENTION

The present invention provides an improvement in the art by providing a drive mechanism for an automatic washer which will effect a slow speed and low impact agitation via a slow speed rotation of the wash basket with a fixed speed motor.

In an embodiment of the invention, a drive mechanism is provided for a vertical axis automatic washer, the washer having a rotatable wash basket, a rotatable agitator concentrically mounted in the wash basket and a drive motor. A first drive shaft is connected to and driven by the motor at a first rotational speed and with a first torque. A second drive shaft is connected to the agitator to rotatingly drive the agitator. A gear mechanism is interposed between the first drive shaft and the second drive shaft to convert the first rotational speed and first torque to a second, lower rotational speed and a second, higher torque at the second drive shaft. A first clutch mechanism is arranged between the wash basket and the first drive shaft to allow for selective driving of the wash basket at the first, higher, rotational speed and a second clutch mechanism is arranged between the wash basket and the second drive shaft to allow for selective driving of the wash basket at the second, lower rotational speed.

The present invention provides a mechanism to rotate the wash basket in an automatic washer at a low speed, equivalent to a wash speed as opposed to a spin speed. This allows for the provision of various delicate wash programs for delicate clothes loads, as well as to build an internal centrifugal re-circulation (stain care program) in a low cost non-variable speed drive automatic washer.

In an embodiment, a planetary drive system may be provided incorporating a clutch system permitting oscillatory driving of the agitator or rotary driving of the basket at low speed and high torque.

In an embodiment of the invention, a clutch tang can be carried on the planetary gear support which is rotationally secured to the agitator shaft and which oscillates with the agitator.

A second clutch tang may be secured to the spin tube which directly connects to the wash basket.

DETAILED DESCRIPTION

Figure 1:
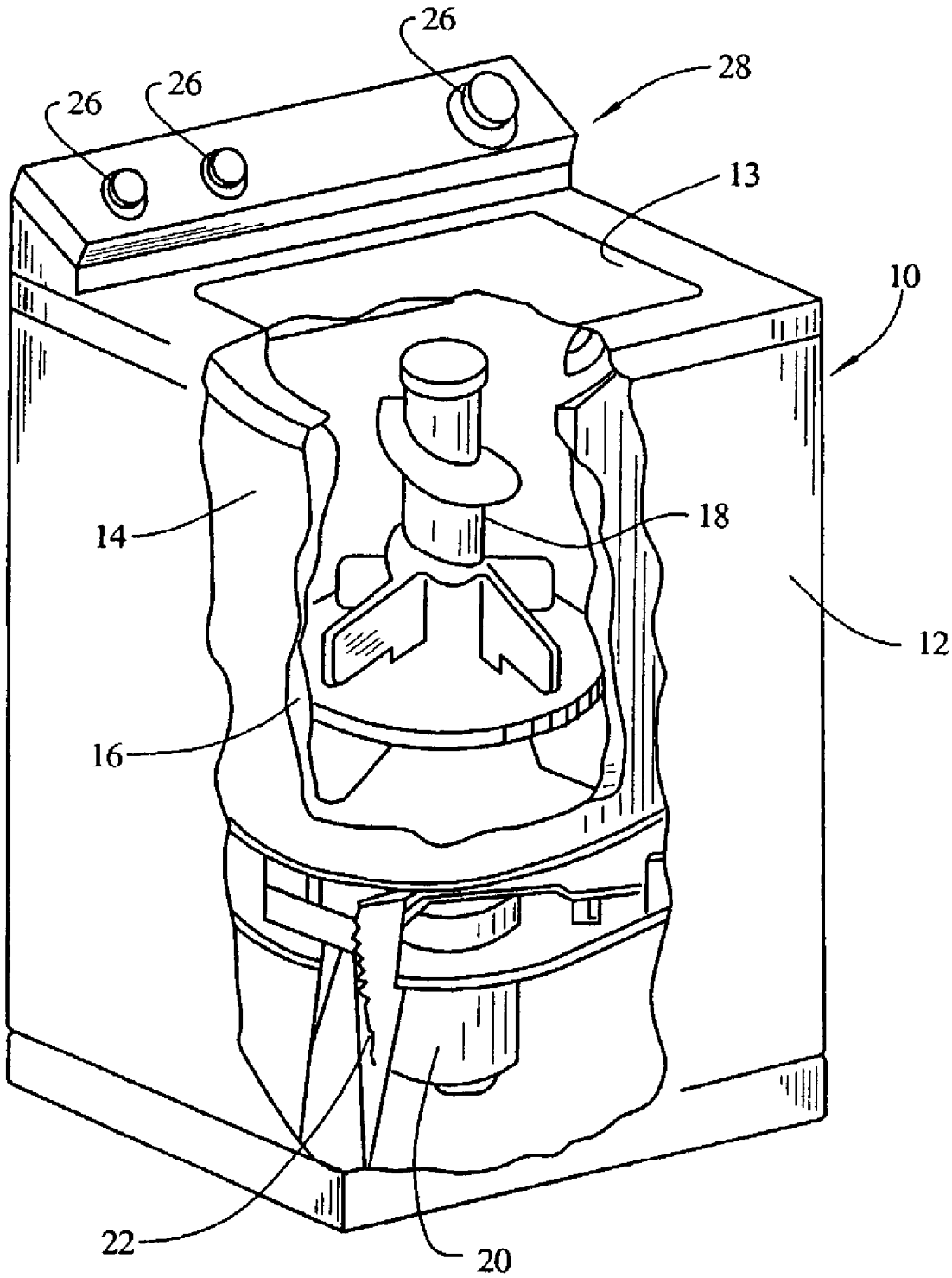
FIG. 1 is a perspective view of an automatic washer embodying the principles of the present invention.

In FIG. 1 there is illustrated an automatic washer generally at 10 embodying the principles of the present invention. The washer has an outer cabinet 12 with an openable lid 13 which encloses an imperforate wash tub 14 for receiving a supply of wash liquid. Concentrically mounted within the wash tub is a wash basket 16 for receiving a load of materials to be washed and a vertical axis agitator 18. A motor 20 is provided which is drivingly connected to the agitator 18 to rotatingly drive it in an oscillatory or rotary manner, and is also selectively connectable to the basket 16 for simultaneous rotation with the agitator 18. The assembly of the tub 14, wash basket 16, agitator 18, and motor 20 is mounted on a suspension system 22. A plurality of controls 26 are provided on a control console 28 for automatically operating the washer through a series of washing, rinsing, and liquid extracting steps.

Figure 2:
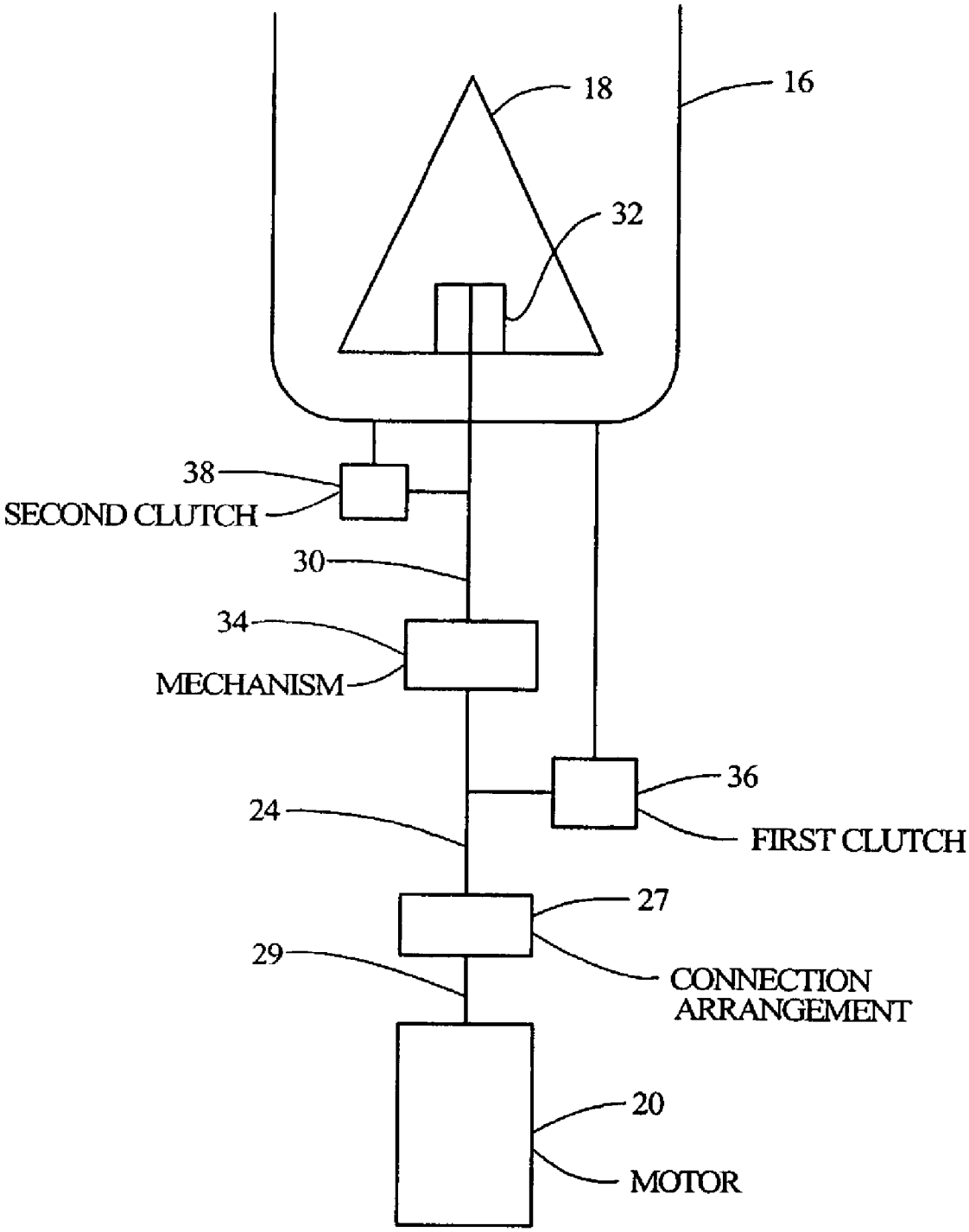
FIG. 2 is a schematic side section view of the drive mechanism and associated components of the automatic washer of FIG. 1.

A drive mechanism for a vertical axis automatic washer is shown schematically in FIG. 2. The washer has the rotatable wash basket 16, the rotatable agitator 18 concentrically mounted in the wash basket and a drive motor 20. The drive mechanism comprises a first drive shaft 24 driven by the motor 20 at a first rotational speed and with a first torque. The first drive shaft 24 is connected, via a connection arrangement 26 to a drive shaft 28 of the motor 20. A second drive shaft 30 is arranged to rotatingly drive the agitator 18. The second drive shaft 30 is connected to the agitator 18 through a connection arrangement 32. A mechanism 34 is arranged between the first drive shaft 24 and the second drive shaft 30 to convert the first rotational speed and first torque to a second rotational speed and a second torque at the second drive shaft 30. A first clutch is arranged between the wash basket 16 and the first drive shaft 24 to allow for selective engagement and disengagement between the wash basket and the first drive shaft. A second clutch 38 is arranged between the wash basket 16 and the second drive shaft 30 to allow for selective engagement and disengagement between the wash basket and the second drive shaft. Although the various connection arrangements 26, 32, the mechanism 34 and the clutches 36, 38 can each be constructed and arranged in a variety of different manners, known to those of ordinary skill in the art in accordance with the principles of the present invention, one particular and preferred embodiment is disclosed below to comply with 35 USC § The present invention, and the claims, however, should not be limited to this particular disclosed embodiment, which is provided only as an exemplary arrangement for carrying out the principles of the present invention.

Figure 3:
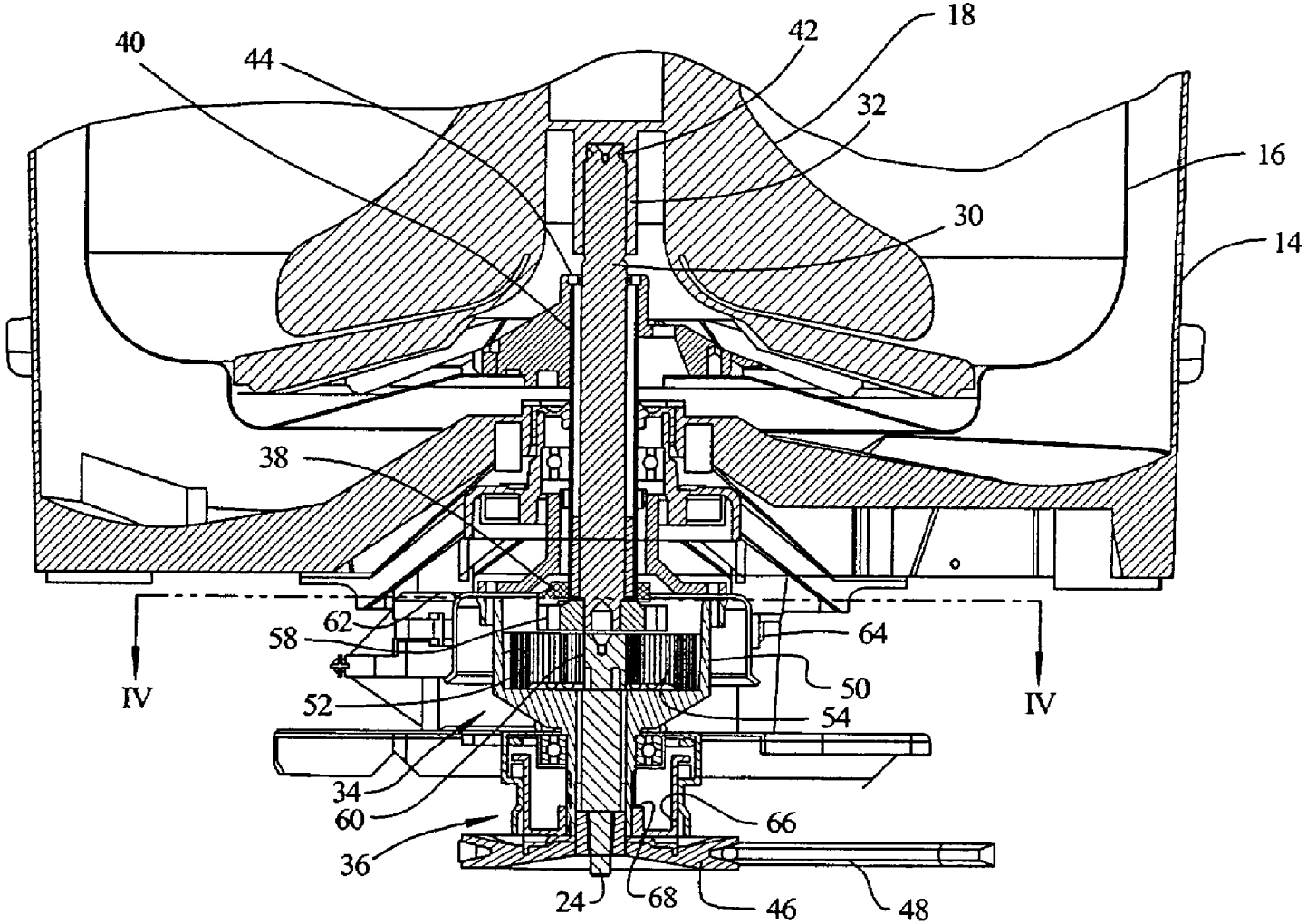
FIG. 3 is a side section view of an embodiment of the invention.

FIG. 3 illustrates a cross sectional view of the drive mechanism arrangement of a preferred embodiment of the present invention and is one of many different embodiments which could be utilized to carry out the present invention. In this embodiment, there is illustrated the wash tub 14 which typically is held stationary in the washing machine and which carries within it the rotatable wash basket 16 which is interconnected to co-rotate with a basket spin tube 40 which is concentrically received around the second drive shaft 30. The second drive shaft 30 connects to the agitator 18 via the connection 32 which, in the embodiment illustrated, comprises a splined connection between an upper end of the second drive shaft 30 and an internal spline recess 42 of the agitator. Other known connection arrangements may be used. A bearing 44 is provided between an upper end of the spin tube 40 and the second drive shaft 30 to permit rotation therebetween. The motor (not shown in this view) is connected to the first drive shaft 24 by means of the connection 26 which, in this preferred arrangement, comprises a pulley 46 secured to rotate with the first drive shaft 24 and a belt 48 interconnecting the pulley 46 with the motor drive shaft 28. Other connections, such as gears or direct connection between the motor drive shaft 28 and the first drive shaft may be used.

Figure 4:
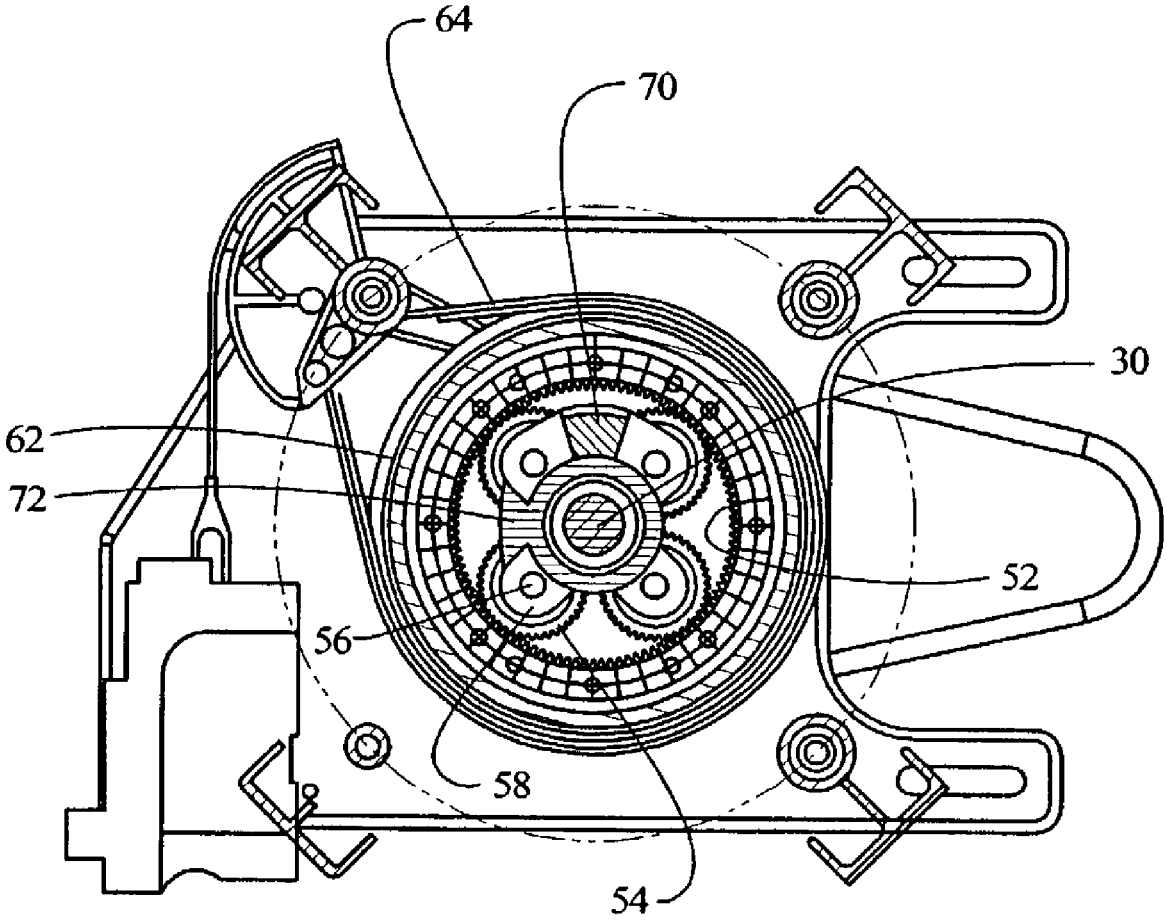
FIG. 4 is a top section view taken generally along the lines IV—IV of FIG. 3.

The mechanism 34 arranged between the first drive shaft 24 and the second drive shaft 30, in this embodiment, comprises a planetary gear system (shown also in FIG. 4). This system includes a gear housing 50 having an internal ring gear 52 which receives four planetary gears which are each rotatable a pin 56 carried in a planet gear carrier 58. A sun gear 60 is formed at a top end of the first drive shaft 24 to engage with the teeth on the planet gears 54. The gear housing 50 is secured to a brake drum 62 to co-rotate therewith and a brake band 64 surrounds the brake drum to selectively hold the brake drum and thereby the gear housing 50 against rotation. The second drive shaft 30 is secured for co-rotation with the planet carrier 58.

The first clutch 36 is arranged between the wash basket 16 and the first drive shaft 24 and, in the preferred embodiment illustrated, comprises a spline clutch such as that disclosed in U.S. Pat. No. 5,172,573, incorporated herein by reference. Other types of clutches could be utilized. In this spline clutch, a clutch slider 66 has clutch teeth which are selectively engageable with clutch teeth carried on the pulley 46 so that the drive from the pulley 36 is selectively transmitted directly to the gear housing 50 through a spline connection 68 between the clutch slider 66 and the gear housing 50. A specific arrangement for actuating this first clutch is disclosed in U.S. Pat. No. 5,172,573 and that disclosure is incorporated herein.

The second clutch 38, in the embodiment illustrated, includes a planetary clutch tang 70 extending upwardly from the planet carrier 58 and a downwardly extending spin tube clutch tang 72 which is secured to co-rotate with the spin tube 40. The two tangs are arranged vertically and radially to interfere with one another so that they are not permitted to rotate past each other but rather will engage each other upon a pre-determined relative rotation between the two tangs, not exceeding 360°. Other types of clutches could also be used for this second clutch 38.

In operation, the motor 20, which has a high speed output, drives the first drive shaft 24 with a relatively high rotational speed and relatively low torque. During the agitate mode, the first clutch 36 is disengaged so that there is no direct drive connection between the pulley 46 and the gear housing 50 and the brake band 64 is tightened to prevent rotation of the gear housing 50. The rotation of the first drive shaft 24 is transmitted through the sun gear 50 to the planet gears 54 which revolve around the sun gear 60 due to the stationary ring gear 52 carried in the gear housing and thus the planet carrier 58 rotates at a much slower speed, but with higher torque than the first drive shaft 24. The second drive shaft 30 is connected to co-rotate with the planet carrier 58 so it rotates at a lower speed and with higher torque than the first drive shaft 24. In the agitate mode, the motor 20 is operated in a reversing manner such that the second drive shaft is rotated in a first direction and then in a second direction without making a full 360° rotation in either direction. Typically the angle of rotation is between 170–240° but may be as much as 300°. The planetary clutch tang 70 therefore is carried through an arc of less than 360° and typically does not repeatedly come into contact with the spin tube clutch tang 72 and therefore the spin tube clutch tang, spin tube 40 and basket 16 remain stationary.

To effect a low impact agitation, the motor 20 is controlled to provide continuous one-way rotation while the first clutch is controlled to hold the gear housing 50 disengaged from the pulley 46 and with the brake band 64 applied to prevent rotation of the gear housing. Once the second drive shaft 30 approaches and completes a full 360° rotation, the planetary clutch tang 70 will pick up the spin tube clutch tang 72 and carry it along, thereby causing the wash basket 16 to co-rotate with the agitator 18 and thus providing a swirling movement of the water within the wash basket. In this construction, the spin tube 40 is not connected to the gear housing 50, and therefore, is free to rotate relative thereto. If desired, this swirling action can be periodically reversed, preferably after at least several rotations of the wash basket in each direction.

To effect a high speed spin of the wash basket, the first clutch 36 is operated to engage the interconnection between the pulley 46 and the gear housing 50 through the clutch slider 66. When this occurs, the ring gears 52, the sun gear 60 and the planet carrier 58 all rotate together at the same rotational speed as the first drive shaft 2 and, within an approximate 360° rotation of the planet carrier 58, the planetary clutch tang 70 will pick up the spin tube clutch tang 72 thereby causing the basket to spin at a high rate of speed equal to the speed of rotation of the first drive shaft 24.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A drive mechanism for a vertical axis automatic washer, the washer having a rotatable wash basket, a rotatable agitator concentrically mounted in the wash basket and a drive motor, the drive mechanism comprising:

a first drive shaft driven by the motor at a first rotational speed and with a first torque, a second drive shaft arranged to rotatingly drive the agitator, a mechanism arranged between the first drive shaft and the second drive shaft to convert the first rotational speed and first torque to a second rotational speed and a second torque at the second drive shaft, a first clutch arranged between the wash basket and the first drive shaft to allow for selective engagement and disengagement between the wash basket and the first drive shaft, a second clutch arranged between the wash basket and the second drive shaft to allow for selective engagement and disengagement between the wash basket and the second drive shaft, and to allow for the wash basket to rotate with the second drive shaft when the wash basket is disengaged from the first drive shaft, but engaged with the second drive shaft, wherein the drive mechanism is configured to effect higher speed and lower torque during a water extraction mode and lower speed and higher torque during an agitation mode.

2. A drive mechanism according to claim 1, wherein the first drive shaft is connected to the motor via a belt and pulley arrangement.

3. A drive mechanism according to claim 1, wherein the second drive shaft is connected to the agitator via a direct spline connection.

4. A drive mechanism according to claim 1, wherein the mechanism comprises a gear mechanism.

5. A drive mechanism according to claim 4, wherein the gear mechanism comprises a planetary gear arrangement.

6. A drive mechanism according to claim 5, wherein the first drive shaft is connected to a sun gear and the second drive shaft is connected to a planetary gear carrier.

7. A drive mechanism according to claim 1, wherein the first drive comprises a spline clutch.

8. A drive mechanism according to claim 4, wherein the wash basket includes a spin tube arranged concentrically around the second drive shaft and the second clutch comprises a tang clutch arranged between the spin tube and the gear mechanism.

9. An automatic washer comprising:

a rotatable wash basket, a rotatable agitator concentrically mounted in the wash basket, a drive motor, a first drive shaft driven by the motor at a first rotational speed and with a first torque, a second drive shaft arranged to rotatingly drive the agitator, a rotatably mounted spin tube arranged concentrically around the second drive shaft, a mechanism arranged between the first drive shaft and the second drive shaft to convert the first rotational speed and first torque to a second rotational speed and a second torque at the second drive shaft, a first clutch arranged between the wash basket and the first drive shaft to allow for selective engagement and disengagement between the wash basket and the first drive shaft, a second clutch arranged between the wash basket and the second drive shaft to allow for selective engagement and disengagement between the wash basket and the second drive shaft and to allow for the wash basket to rotate with the second drive shaft when the wash basket is disengaged from the first drive shaft, but engaged with the second drive shaft.

10. An automatic washer according to claim 9, wherein the first drive shaft is connected to the motor via a belt and pulley arrangement.

11. A drive mechanism according to claim 9, wherein the second drive shaft is connected to the agitator via a direct spline connection.

12. A drive mechanism according to claim 9, wherein the mechanism comprises a gear mechanism.

13. A drive mechanism according to claim 12, wherein the gear mechanism comprises a planetary gear arrangement.

14. A drive mechanism according to claim 13, wherein the first drive shaft is connected to a sun gear and the second drive shaft is connected to a planetary gear carrier.

15. A drive mechanism according to claim 9, wherein the first clutch comprises a spline clutch.

16. A drive mechanism according to claim 12, wherein the second clutch comprises a tang clutch arranged between the spin tube and the gear mechanism.

17. A drive mechanism for a vertical axis automatic washer, the washer having a rotatable wash basket, a rotatable agitator concentrically mounted in the wash basket and a drive motor, the drive mechanism comprising:

a first drive shaft driven by the motor at a first rotational speed and with a first torque, a second drive shaft arranged to rotatingly drive the agitator, a planetary gear arrangement arranged between the first drive shaft and the second drive shaft to convert the first rotational speed and first torque to a second rotational speed and a second torque at the second drive shaft, a spline clutch arranged between the wash basket and the first drive shaft to allow for selective engagement and disengagement between the wash basket and the first drive shaft, a tang clutch arranged between the wash basket and the second drive shaft to allow for selective engagement and disengagement between the wash basket and the second drive shaft.

18. An automatic washer according to claim 17, wherein the first drive shaft is connected to the motor via a belt and pulley arrangement.

19. A drive mechanism according to claim 17, wherein the second drive shaft is connected to the agitator via a direct spline connection.

20. A drive mechanism according to claim 17, wherein the first drive shaft is connected to a sun gear and the second drive shaft is connected to a planetary gear carrier.

* * * * *